US008821180B2

(12) United States Patent
Blakborn et al.

(10) Patent No.: US 8,821,180 B2
(45) Date of Patent: Sep. 2, 2014

(54) PLUG-TYPE CONNECTOR HAVING A RADIALLY ACTING LATCHING DEVICE

(75) Inventors: Willem Blakborn, Inzell (DE); Waldemar Winterholler, Traunreut (DE)

(73) Assignee: Rosenberger Hochfrequenztechnik GmbH & Co., KG, Fridolfing (DE)

( * ) Notice: Subject to any disclaimer, the term of this patent is extended or adjusted under 35 U.S.C. 154(b) by 73 days.

(21) Appl. No.: 13/704,378

(22) PCT Filed: Apr. 12, 2011

(86) PCT No.: PCT/EP2011/001831

§ 371 (c)(1), (2), (4) Date: Jan. 28, 2013

(87) PCT Pub. No.: WO2012/000576

PCT Pub. Date: Jan. 5, 2012

(65) Prior Publication Data

US 2013/0122732 A1 May 16, 2013

(30) Foreign Application Priority Data

Jun. 28, 2010 (DE) ..... 20 2010 009 597 U

(51) Int. Cl.
*H01R 13/627* (2006.01)
*H01R 13/639* (2006.01)
*H01R 13/6581* (2011.01)

(52) U.S. Cl.
CPC ..... *H01R 13/639* (2013.01); *H01R 13/6277* (2013.01); *H01R 13/6581* (2013.01)
USPC ..... 439/357

(58) Field of Classification Search
USPC ..... 439/357, 321, 578–585, 349–350, 352, 439/752, 358
See application file for complete search history.

(56) References Cited

U.S. PATENT DOCUMENTS

| | | | | |
|---|---|---|---|---|
| 3,193,309 A | | 7/1965 | Morris | |
| 3,793,610 A | * | 2/1974 | Brishka | 439/349 |
| 5,704,809 A | * | 1/1998 | Davis | 439/578 |
| 5,823,813 A | | 10/1998 | Dye | |

(Continued)

FOREIGN PATENT DOCUMENTS

| | | |
|---|---|---|
| DE | 3823617 A1 | 1/1990 |
| DE | 20018583 U1 | 12/2000 |

(Continued)

*Primary Examiner* — Jean F Duverne
(74) *Attorney, Agent, or Firm* — DeLio, Peterson & Curcio, LLC; Robert Curcio

(57) ABSTRACT

A plug-type connector having an external conductor part, at least one internal conductor part, and a housing, wherein a radially acting latching device for mechanically releaseably locking the plug-type connector in a plugged-in state is provided on an outer circumference of the housing, the latching device being produced from a spring-elastic material in the form of a ring which has a gap in the circumferential direction, wherein a bolt which can be moved between a locking position and a release position is arranged on the housing such that the bolt engages in the gap in the ring preventing radial compression of the ring in the locking position, and, in the release position, releases the gap in the ring so that the ring can be radially compressed when a stop edge runs onto one of the chamfers on the sides of the ring when the plug-connected state is established or released.

23 Claims, 8 Drawing Sheets

(56) References Cited

U.S. PATENT DOCUMENTS

| | | | | |
|---|---|---|---|---|
| 5,938,465 | A | 8/1999 | Fox, Sr. | |
| 6,805,583 | B2 * | 10/2004 | Holliday et al. | 439/578 |
| 6,825,417 | B2 * | 11/2004 | Ball | 174/74 R |
| 7,160,133 | B2 * | 1/2007 | Karadimas et al. | 439/352 |
| 7,351,098 | B2 * | 4/2008 | Gladd et al. | 439/578 |
| 7,479,025 | B2 * | 1/2009 | Lee et al. | 439/349 |
| 8,591,244 | B2 * | 11/2013 | Thomas et al. | 439/321 |

FOREIGN PATENT DOCUMENTS

| | | | |
|---|---|---|---|
| DE | 102006047039 | A1 | 11/2007 |
| EP | 0996201 | A2 | 4/2000 |
| EP | 1401060 | A1 | 3/2004 |

* cited by examiner

PLUG-TYPE CONNECTOR HAVING A RADIALLY ACTING LATCHING DEVICE

BACKGROUND OF THE INVENTION

1. Field of the Invention

The present invention relates to a plug-type connector having an external conductor part which is formed on a cable-side end of the plug-type connector for electrical and mechanical connection with an external conductor of a cable and which forms an electromagnetic screen of the plug-type connector, having at least one internal conductor part which is formed on the cable-side end of the plug-type connector for electrical and mechanical connection with at least one internal conductor of a cable, and having a housing, wherein a radially acting latching device is provided on an outer circumference of the housing for locking the plug-type connector, in a mechanically releasable manner, in a plugged-in state in which the plug-type connector is plugged, with a plug-side end axially opposite the cable-side end, into a complementary plug-type connector and an electrical and mechanical contact is established between the internal conductor part of the plug-type connector and a complementary internal conductor part of the complementary plug-type connector as well as establishing an electrical and mechanical contact between the external conductor part of the plug-type connector and a complementary external conductor part of the complementary plug-type connector, wherein the latching device is manufactured from a spring-elastic material in the form of a ring which has a gap in the circumferential direction, wherein the ring is arranged on the outer circumference of the housing in a plane perpendicular to a longitudinal axis of the plug-type connector, such that a first side of the ring faces the plug-side end of the plug-type connector and a second side of the ring faces the cable-side end of the plug-type connector, wherein the ring projects in a radial direction from the outer circumference of the housing, wherein an inner diameter of the ring is greater than an outer diameter of the housing in the section in which the ring is located, so that the ring can be compressed radially against a spring-elastic force, in accordance with the preamble to claim 1.

2. Description of Related Art

An electrical plug-type connector is known from DE 38 23 617 C2 in which a metallic housing sleeve and a plug contact housing made of an electrically insulating material are clipped together via a snap ring.

U.S. Pat. No. 5,938,465 discloses a rapidly connectable and disconnectable electrical plug-type connector comprising a plug part and a socket part. A spring ring with a gap in the circumferential direction is arranged in a circumferential groove on the plug part, so that when the plug and socket are plugged together the spring ring is compressed radially. In the socket part, the spring ring snaps into a circumferential groove on an inner side of the socket part, providing a holding force between the plug part and socket part. In addition, the spring ring has a notch running in the circumferential direction which provides a part of the spring ring with an additional, radial spring effect, so that a double spring effect is available in a radial direction. A blocking device which blocks a radial compression of the spring ring is not provided.

EP 0 996 201 A2 discloses an electrical plug-type connector comprising a first connector part and a second connector part, wherein the first and second connector part can be plugged into one another, and an engaging device. The engaging device possesses on the first connector part a circumferential groove, a C-formed ring which can be expanded and compressed radially in a resilient manner and which is arranged in the circumferential groove, and possesses on the second connector part a pressure section with which the ring comes into contact when the parts are plugged together, and an engaging groove into which the ring snaps. A first projection is provided on the first connector part which engages with a notch on a rear end of the ring, preventing a displacement of the ring in a circumferential direction. A limiting part is also provided on the first connector part which extends into the circumferential groove and is of such a width that it covers a slit in the ring on the outer circumference of the ring. This prevents an excessive radial expansion of the ring. When plugging together the two connector parts, the ring is compressed radially and relaxes again through radial expansion as soon as it has reached the engaging groove. In order to release the plugged connection, an axially displaceable sleeve is provided on the second connector part which compresses the ring radially in a predetermined axial position, thus releasing the engagement between the ring and the engaging groove. No bolt is provided which blocks a radial compression of the ring.

BRIEF SUMMARY OF THE INVENTION

The above and other objects, which will be apparent to those skilled in the art, are achieved in the present invention which is directed to a plug-type connector comprising an external conductor part which is formed on a cable-side end of the plug-type connector for electrical and mechanical connection with an external conductor of a cable and which forms an electromagnetic screen of the plug-type connector, having at least one internal conductor part which is formed on the cable-side end of the plug-type connector for electrical and mechanical connection with at least one internal conductor of the cable, and a housing including a radially acting latching device on an outer circumference of the housing for locking the plug-type connector in a mechanically releasable manner in a plugged-in state in which the plug-type connector is plugged, with a plug-side end axially opposite the cable-side end, into a complementary plug-type connector such that an electrical and mechanical contact is established between the internal conductor part of the plug-type connector and a complementary internal conductor part of the complementary plug-type connector as well an electrical and mechanical contact between the external conductor part of the plug-type connector and a complementary external conductor part of the complementary plug-type connector, the latching device comprising a resilient material in the form of a ring having a gap in the circumferential direction, wherein the ring is arranged on the outer circumference of the housing in a plane perpendicular to a longitudinal axis of the plug-type connector, such that a first side of the ring faces the plug-side end of the plug-type connector and a second side of the ring faces the cable-side end of the plug-type connector, wherein the ring projects in a radial direction from the outer circumference of the housing, and the ring inner diameter is greater than the ring outer diameter in the section in which the ring is located, so that the ring can be compressed radially against a spring-elastic force, the ring having a chamfer on the first and second side such that the ring has a shorter axial length on its outer circumference than on its inner circumference, wherein a bolt which can be moved between a locking position and a release position is arranged on the housing in such a way that in the locking position the bolt engages in the gap in the ring and prevents radial compression of the ring, and in the release position releases the gap in the ring so that the ring can be radially compressed when a stop edge runs onto one of the chamfers on the sides of the ring when the plug-connected state is established or released.

The bolt may form a slider which can be moved in an axial direction. The bolt is designed to fit only into the gap in the ring when the ring is in a completely relaxed state, in a radial direction, without any radial restoring forces acting radially outwards. The bolt may a rocker made of a resilient material which is formed integrally with the bolt.

The housing may be part of the external conductor part. A radial groove runs around the outer circumference of the housing for receiving the ring. An elastic spring element may be used for applying an elastic spring force to the bolt in the direction of the locking position. The elastic spring element may comprise a helical spring which applies the spring-elastic force to the slider in an axial direction.

The plug-type connector may include a device for electrical testing of the complete establishment of a plugged connection between the plug-type connector and a complementary plug-type connector. The device for electrical testing of the complete establishment of a plugged connection reports a completely established plugged connection if, in the plugged-in state, the bolt is in its locking position.

The device for electrical testing of the complete establishment of a plugged connection may comprise an interrupted electrical conductor which is electrically closed when the plug-type connector is completely plugged into the complementary plug-type connector and the ring is locked by the bolt.

The device for electrical testing of the complete establishment of a plugged connection may comprise a reed contact which is electrically closed when the plug-type connector is completely plugged into the complementary plug-type connector and the ring is locked by the bolt.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

Figure 1:
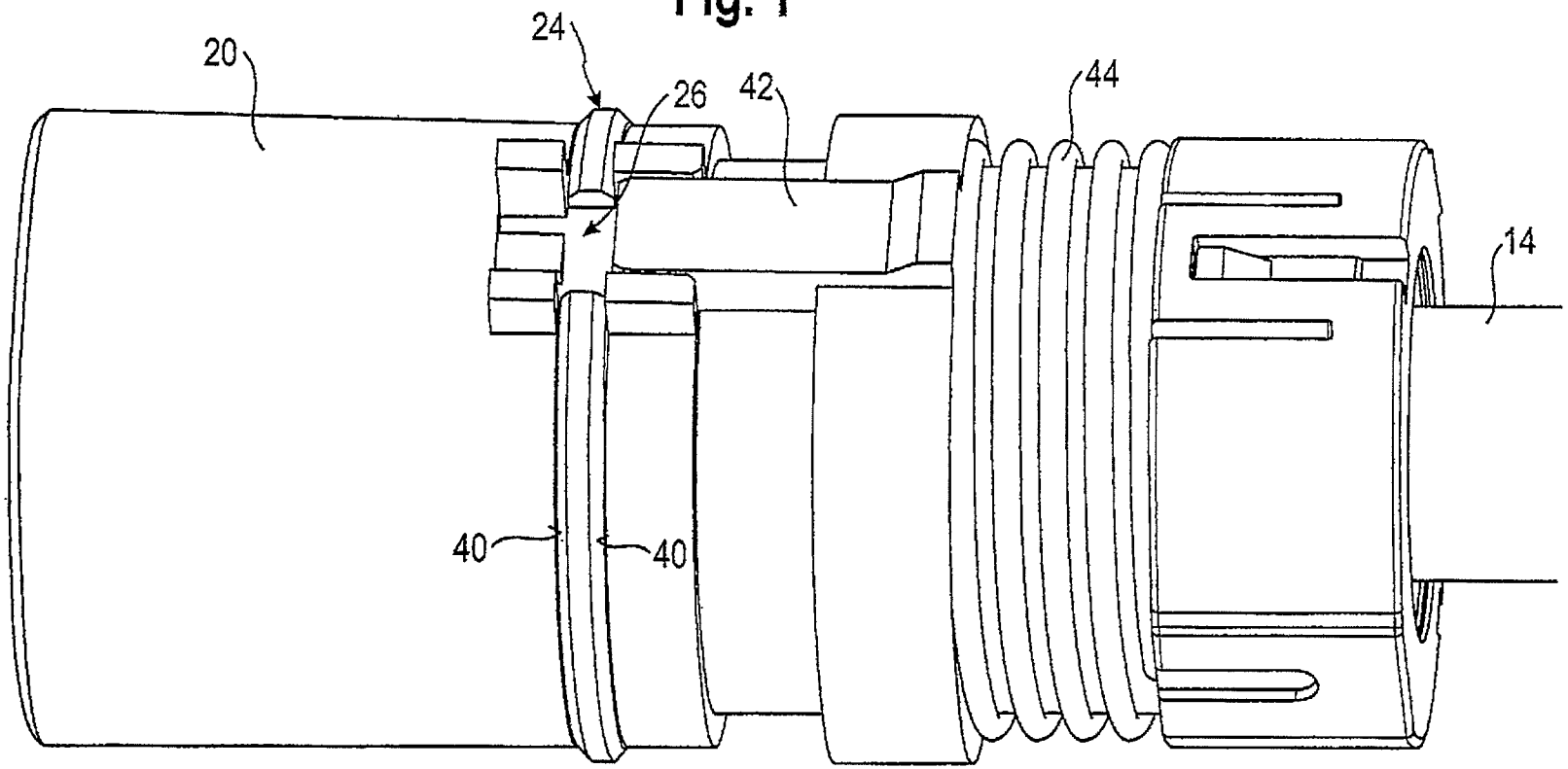
FIG. 1 shows a perspective view of a first preferred embodiment of a plug-type connector in accordance with the invention with a bolt in release position.
Figure 2:
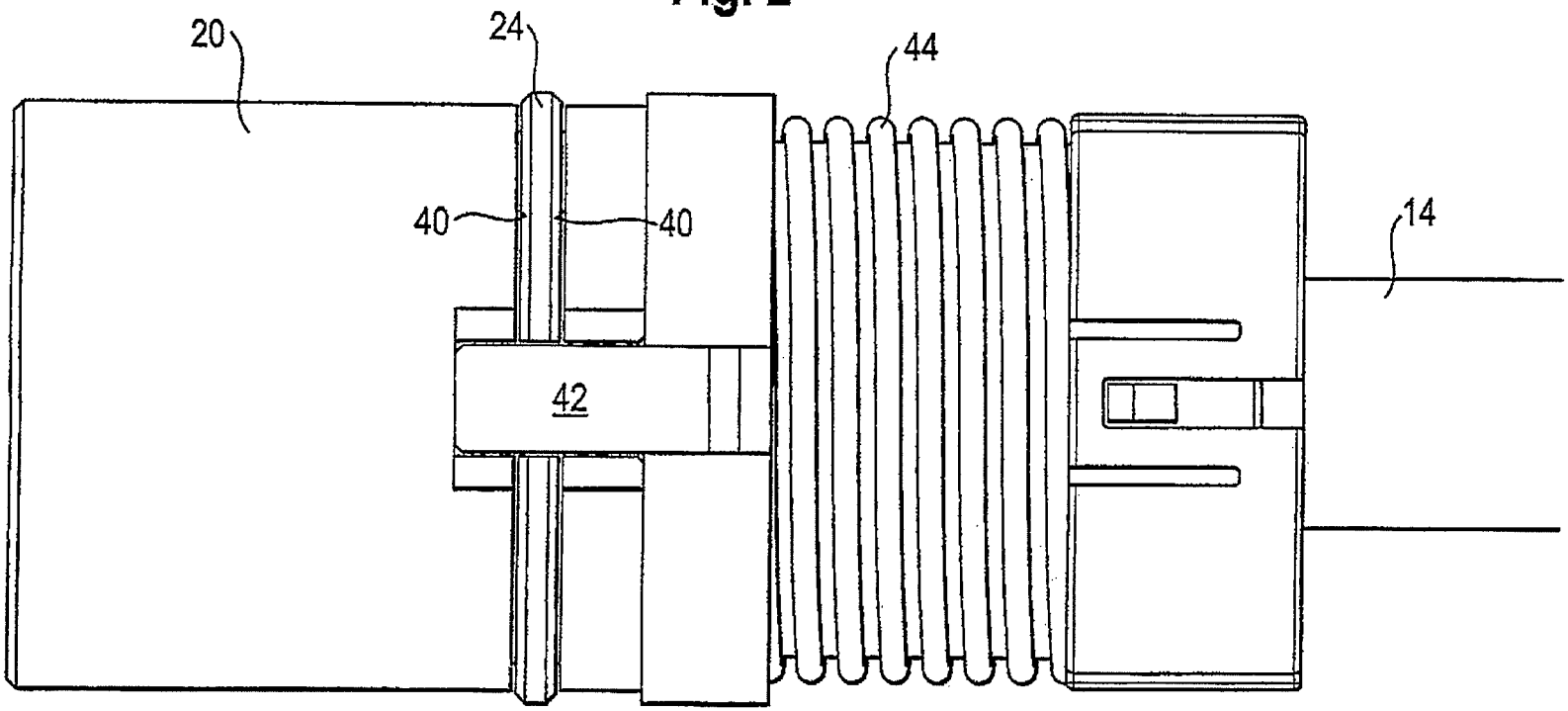
FIG. 2 shows a side view of the first preferred embodiment of a plug-type connector in accordance with the invention as shown in FIG. 1 with a bolt in locking position.
Figure 3:
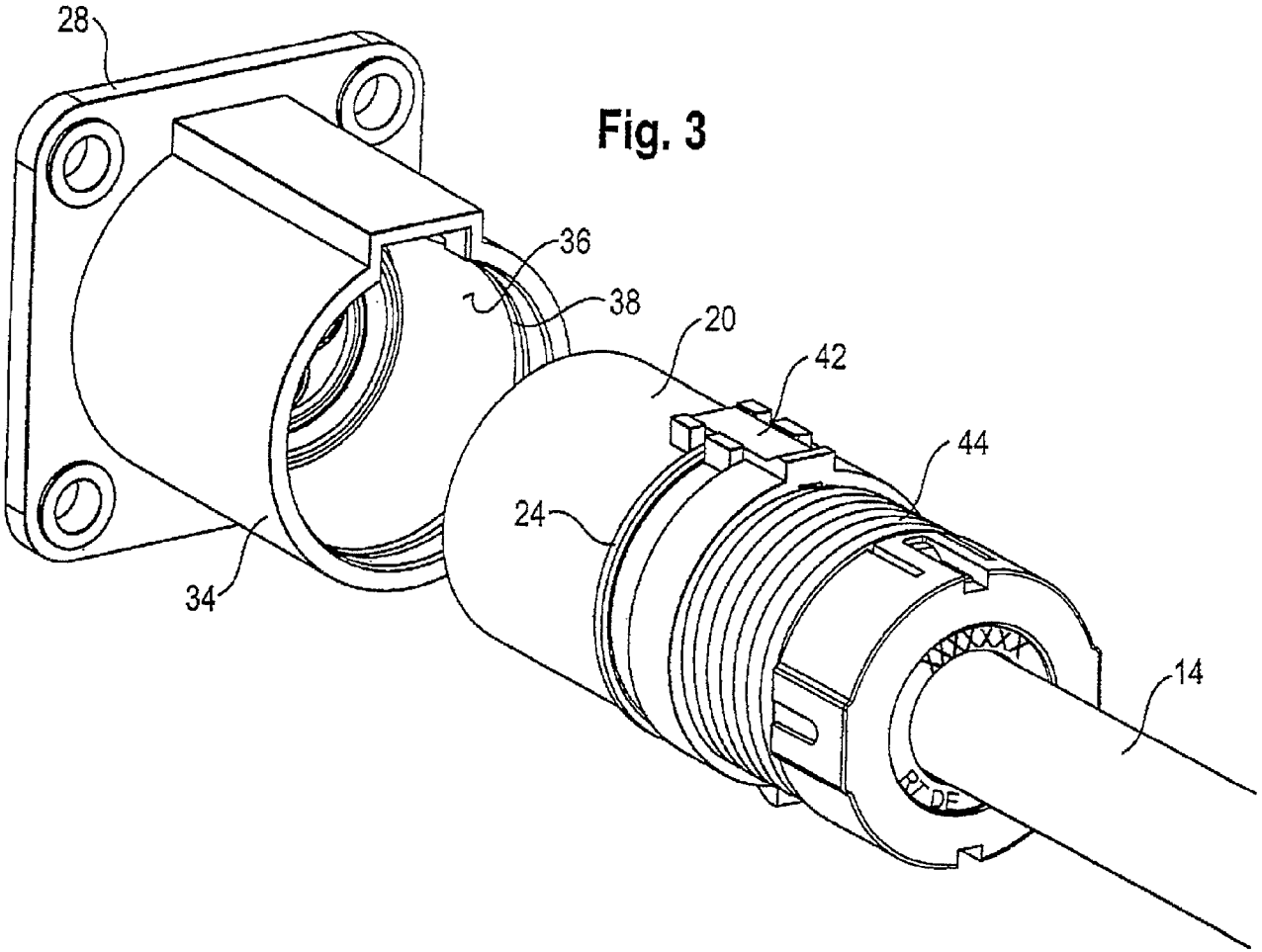
FIG. 3 shows a perspective view of the first preferred embodiment of a plug-type connector in accordance with the invention as shown in FIG. 1 with a complementary plug-type connector in unplugged state.

The invention is based on the problem of designing a plug-type connector of the aforementioned type in such a way that, on the one hand, a plugged-together state can be established simply and releasably, and on the other hand an undesired release of the plugged connection is reliably prevented.

According to the invention this problem is solved through a plug-type connector of the aforementioned type with the features identified in the claims.

According to the invention, in a plug-type connector of the aforementioned type the ring has a chamfer on the first and second side such that the ring has a shorter axial length on its outer circumference than on its inner circumference, wherein a bolt, which can be moved between a locking position and a release position, is arranged on the housing in such a way that in the locking position the bolt engages in the gap in the ring and prevents radial compression of the ring, and in the release position releases the gap in the ring so that the ring can be radially compressed when a stop edge runs onto one of the chamfers on the sides of the ring when the plug-connected state is established or released.

This has the advantage that the plug-type connector can be connected with a complementary plug-type connector in such a way that, on the one hand, this plugged connection can be released, but on the other hand it can only be released by means of special measures. An undesired release of the plugged connection, for example through vibrations, is effectively prevented, wherein at the same time the manual establishment and release of the plugged connection is achieved simply and with minimal application of force.

A particularly functionally reliable embodiment in terms of the locking of the ring is achieved in that the bolt takes the form of a slider which can be moved in an axial direction.

A particularly simple structure which makes the plug-type connector economical to manufacture and assemble is achieved in that the housing is a part of the external conductor part.

An axial fixing of the ring to the outer side of the housing is achieved in that a radial groove running around the outer circumference of the housing is formed in which the ring is arranged.

Due to the bolt being so designed that it only fits into the gap in the ring when the ring is in a completely relaxed state, in a radial direction, without any radial restoring forces acting radially outwards, the bolt at the same time makes it possible to check that a plugged connection of the plug-type connector with a complementary mating connector has been completely established, since otherwise the bolt cannot be moved into the locking position.

An automatic locking of the ring when plugging the plug-type connector into a complementary plug-type connector is achieved in that an elastic spring element is provided which applies an elastic spring force to the bolt in the direction of the locking position.

A particularly reliable locking is achieved in that the elastic spring element takes the form of a helical spring which applies the spring-elastic force to the slider in an axial direction.

A particularly simple structure allowing economical manufacture and assembly of the plug-type connector is achieved in that the bolt possesses a rocker made of a resilient material which is formed integrally with the bolt.

An additional security for the plugged connection and for a user of the plug-type connector is achieved in that a device for electrical testing of the complete establishment of a plugged connection between the plug-type connector and a complementary plug-type connector is additionally arranged on the plug-type connector. For example, this cuts off an electric voltage transmitted via the cable of the plug-type connector as soon as the device for electrical testing of the complete establishment of a plugged connection reports that a complete plugged connection no longer exists. In this way a user is protected from receiving an electric shock from any freely accessible electrical contacts of the plug-type connector.

A functionally reliable detection of the complete and locked plugged connection between the plug-type connector and the complementary plug-type connector is achieved in that the device for electrical testing of the complete establishment of a plugged connection is arranged on the bolt in such a way that the device for electrical testing of the complete establishment of a plugged connection only reports a completely established plugged connection if, in the plugged-in state, the bolt is in its locking position.

A particularly simple structure allowing economical manufacture and assembly of the plug-type connector is achieved in that the device for electrical testing of the complete establishment of a plugged connection is an interrupted electrical conductor which is arranged and designed such that the electrical conductor is electrically closed when the plug-type connector is completely plugged into the complementary plug-type connector and the ring is locked by the bolt.

A particularly functionally reliable detection of the complete plugged connection through a contact-free sensor is achieved in that the device for electrical testing of the complete establishment of a plugged connection is a reed contact which is arranged and designed such that the reed contact is electrically closed when the plug-type connector is completely plugged into the complementary plug-type connector and the ring is locked by the bolt.

The first preferred embodiment of a plug-type connector in accordance with the invention shown in FIGS. 1 to 5 comprises an external conductor part 10, which is formed on a cable-side end of the plug-type connector for electrical and mechanical connection with an external conductor 12 of a cable 14 and forms an electromagnetic screen of the plug-type connector. Several internal conductor parts 16 which are held radially at predetermined points within the external conductor part 10 by an insulating part 18 are arranged radially within the external conductor part 10. The internal conductor parts 16 are designed for electrical and mechanical connection with at least one internal conductor (not shown) of the cable 14. A housing 20 encloses the external conductor part 10.

Figure 4:
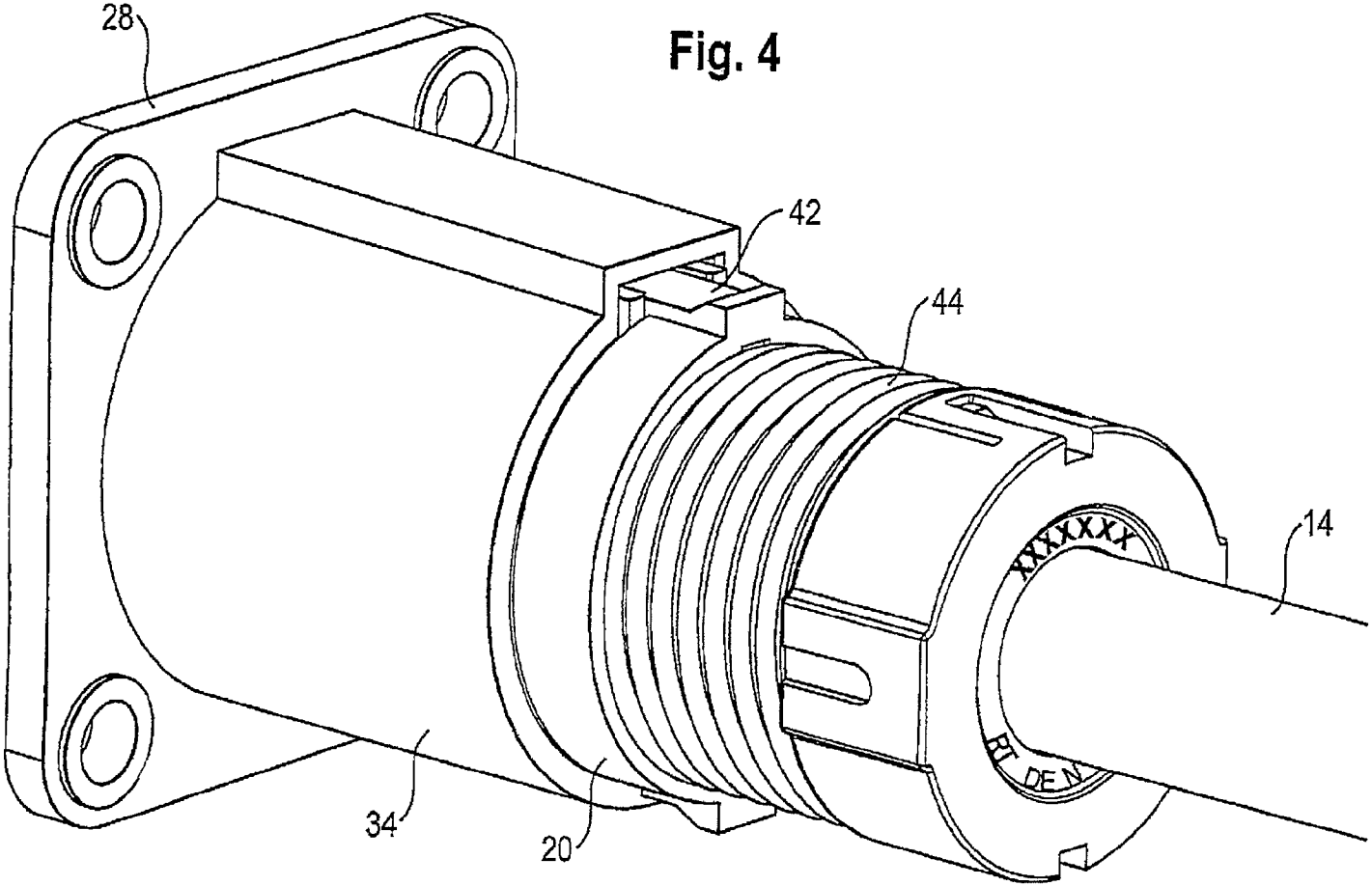
FIG. 4 shows a perspective view of the first preferred embodiment of a plug-type connector in accordance with the invention as shown in FIG. 1 with a complementary plug-type connector in plugged-in state.
Figure 5:
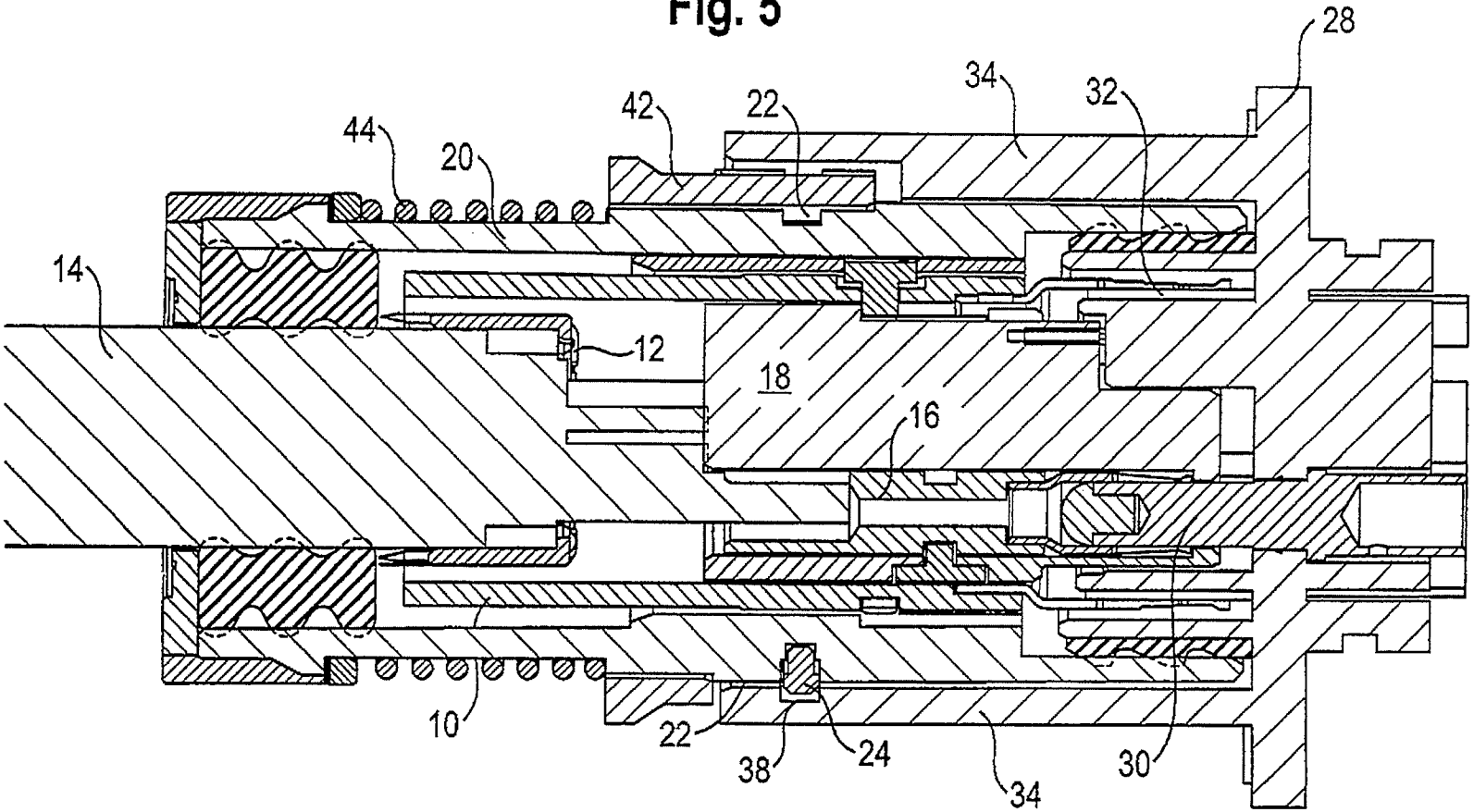
FIG. 5 shows a cross-sectional view of the first preferred embodiment of a plug-type connector in accordance with the invention as shown in FIG. 1 with a complementary plug-type connector in plugged-in state.

A ring 24 is arranged in a groove 22 on the outer circumference of the housing 20 which has a gap 26 in the circumferential direction (FIG. 1) and is manufactured of a resilient material. At the same time, an inner diameter of the ring 24 is greater than an outer diameter of the housing 20 in the region of the groove 22. In this way the ring 24 can be compressed radially inwards, so that the outer diameter of the ring 24 is reduced. In contrast, the outer diameter of the ring 24 is greater than an outer diameter of the housing 20 adjacent to the groove 22, so that the ring 24 projects outwards from the housing in a radial direction. This ring 24 serves as a radially acting latching device for mechanically releasable locking of the plug-type connector in a plugged-in state in which the plug-type connector is plugged into a complementary plug-type connector 28, as shown in FIGS. 4 and 5, and an electrical and mechanical contact between the internal conductor part 16 of the plug-type connector and a complementary internal conductor part 30 of the complementary plug-type connector 28 is established, as well as an electrical and mechanical contact between the external conductor part 10 of the plug-type connector and a complementary external conductor part 32 of the complementary plug-type connector 28. The housing 20 of the plug-type connector is hereby plugged into a complementary housing 34 of the complementary plug-type connector 28. This mechanically releasable locking is explained in more detail in the following.

A radial circumferential latching groove 38 is formed on an inner wall 36 of the complementary housing 34 of the complementary plug-type connector 28 which interacts with the ring 24. The inner wall 36 of the complementary housing 34 of the complementary plug-type connector 28 has an inner diameter which is, on the one hand, greater than the outer circumference of the housing 20 adjacent to the groove 22 and, on the other hand, is less than an outer circumference of the ring 24 in its relaxed state. The ring 24 also has chamfers 40 on its side surfaces which act as leading ramps for the inner surface 36 of the complementary housing 34. When the housing 20 is plugged into the complementary housing 34 the complementary housing 34 comes into contact with one side of the ring 24 in the region of the chamfer 40. Under the axial plugging force, the complementary housing 34 compresses the ring 24 radially inwards, so that the outer diameter of the ring 24 is reduced and the complementary housing 34 slides over the housing 20, whereby the ring 24 slides along the inner wall 36 of the complementary housing 34. The housing 20 is now pushed in an axial direction into the complementary housing 34 of the complementary plug-type connector 28 until the ring 24 reaches the latching groove 38. Here, the ring snaps into place, widening radially outwards. In order to release the plugged connection, an axial force is applied to the plug-type connector and complementary plug-type connector in the opposite direction to the direction of plugging, whereby an edge of the latching groove 38 comes into contact with the corresponding opposing chamfer 40 of the ring 24. The ring 24 is again compressed radially inwards, so that the housing 20 can be withdrawn from the complementary housing 34 of the complementary plug-type connector 28. The chamfers 40 ensure, on the one hand, that the latching of the ring 24 in the latching groove 38 is releasable. On the other hand, the chamfers 40 determine the corresponding axial force which is necessary in order to plug together and unplug the plug-type connector and complementary plug-type connector 28.

In order to prevent the plugged connection from being released unintentionally, an axially moveable bolt 42 is provided on the outer circumference of the housing 20. This bolt 42 can be moved in an axial direction between a locking position, as shown in FIGS. 2 to 5, and a release position, as shown in FIG. 1. The bolt 42 is designed in such a way that, in the locking position, it engages in the gap 26 of the ring 24 and prevents the free ends of the ring 24 from being able to move towards one another in a circumferential direction. This blocks any radial compression of the ring 24. In this locking position, an unplugging of the plugged-together plug-type connector and complementary plug-type connector is blocked, since the ring 24 cannot be released from the groove 38 of the complementary plug-type connector.

A helical spring 44 applies an elastic spring force to the bolt 42 in the direction of the locking position. In this way the bolt 42 automatically assumes the locking position as soon as the plug-type connector is completely plugged into the complementary plug-type connector 28, without this requiring any additional action by an installer. In order to plug together and unplug the plug-type connector and complementary plug-type connector 28 it is simply necessary to move the bolt 42 against the force of the helical spring 44 from the locking position into the release position and hold it there until, when plugging the connectors together, the ring 24 is located in the housing 34 of the complementary plug-type connector 28 or, when releasing the plugged connection, until the ring 24 has left the groove 38 of the complementary plug-type connector 28. In the intermediate stage, for example when plugging together the plug-type connector and complementary plug-type connector 28, in which the ring 24 is already located within the housing 34 of the complementary plug-type connector 28 and is thus radially compressed, whereas, however, the ring has not yet snapped into the groove 38 of the complementary plug-type connector 28, a movement of the bolt 42 into the locking position is blocked, since the gap 26 is too small to admit the bolt 42. Only when the ring 24 snaps into the groove 38 of the complementary plug-type connector 28, expanding radially, does the gap 26 become large enough so that, under the action of the force of the helical spring 44, the bolt 42 slides from the release position into the locking position. This provides an installer with a simple means of checking optically whether or not the plug-type connector is pushed completely into the complementary plug-type connector 28. If this is not the case, the bolt 24 is still in the release position. The installer therefore pushes the plug-type connector axially into the complementary plug-type connector 28 until the bolt 42 automatically snaps back into the locking position. This is the indicator for the installer that the plugged connection between the plug-type connector and complementary plug-type connector 28 has been completely and correctly established.

In the plugged-together state, electrical energy is transmitted via the internal conductor part 16 of the plug-type connector. This serves, for example, as a carrier of information, i.e., to transmit an electrical signal. However, it is also possible to transmit electrical energy in order, for example, to drive an electric motor via the plug-type connector in accordance with the invention. In the latter case, high electric currents are transmitted and correspondingly high electric voltages may be present in the internal conductor parts 16 of the plug-type connector and/or the complementary internal conductor parts 30 of the complementary plug-type connector 28. It is therefore important that an installer or other person releasing the plugged connection is prevented from accidentally coming into contact with the internal conductor parts 16 or 30 of the plug-type connector or complementary plug-type connector which are carrying an electric voltage. For this purpose, the internal conductor parts 16 of the plug-type connector can, for example, be so designed that it is not mechanically possible to touch the internal conductor parts 16 of the plug-type connector with a part of the body, for example the fingers. Alternatively, when the plugged connection between the plug-type connector and complementary plug-type connector 28 is released, an electric voltage present in the internal conductor parts 16 of the plug-type connector is cut off. For this purpose, a corresponding detector is provided which detects the establishment or release of the plugged connection between the plug-type connector and complementary plug-type connector 28 and reports this to a corresponding control device which then activates or deactivates the electric voltage for the plug-type connector or the complementary plug-type connector accordingly.

Figure 6:
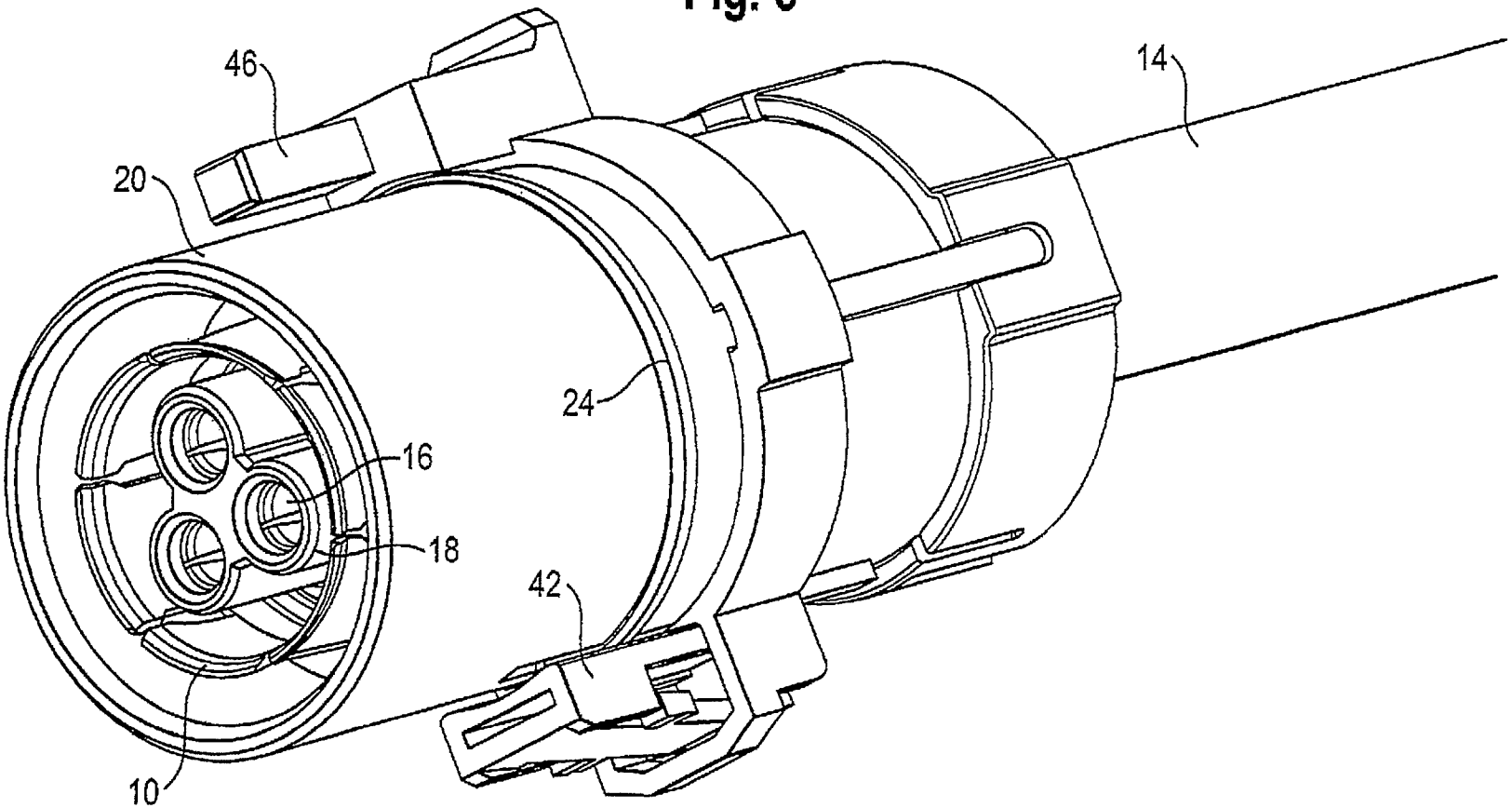
FIG. 6 shows a perspective view of a second preferred embodiment of a plug-type connector in accordance with the invention.
Figure 7:
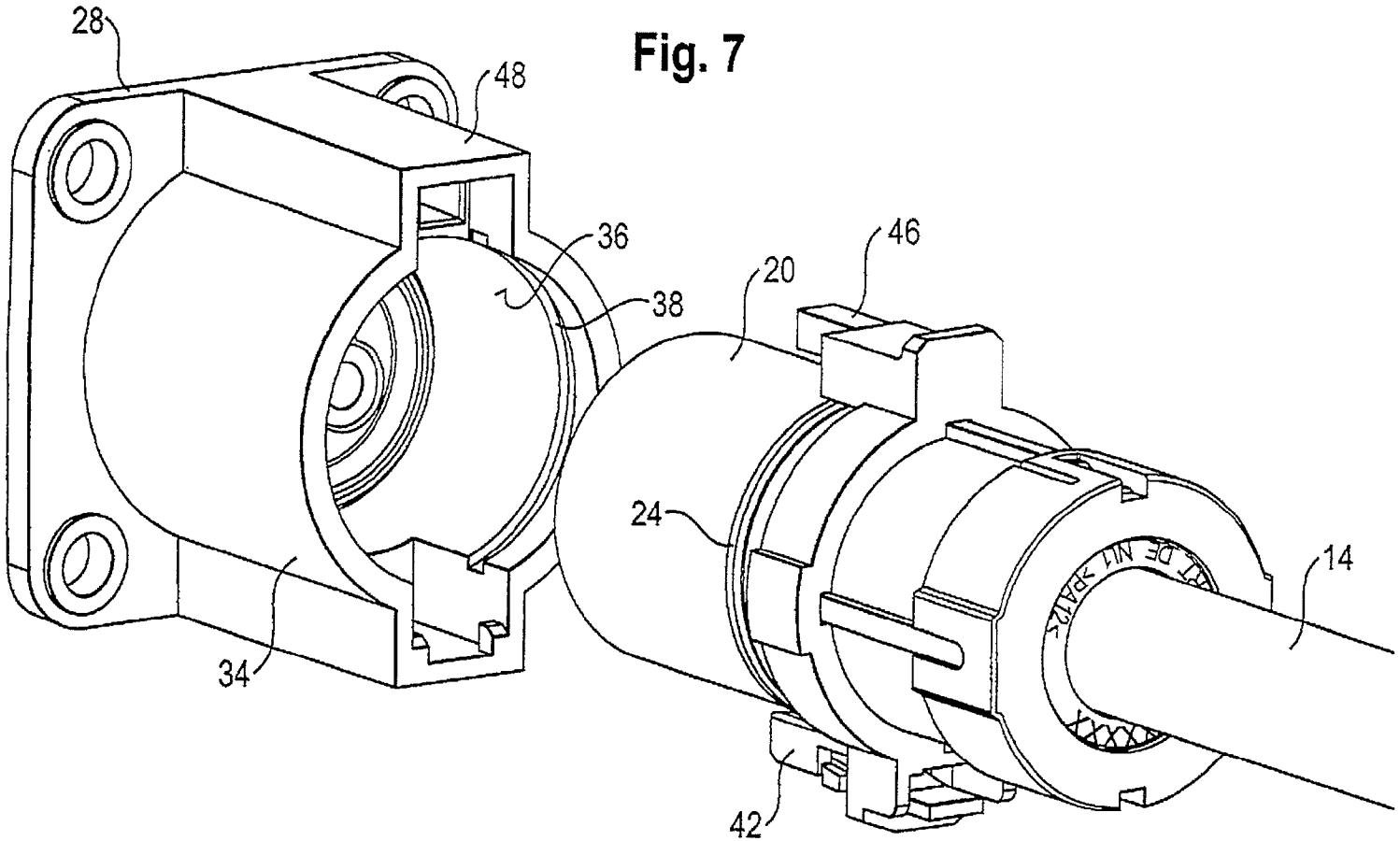
FIG. 7 shows a perspective view of the second preferred embodiment of a plug-type connector in accordance with the invention as shown in FIG. 6 with a complementary plug-type connector in unplugged state.
Figure 8:
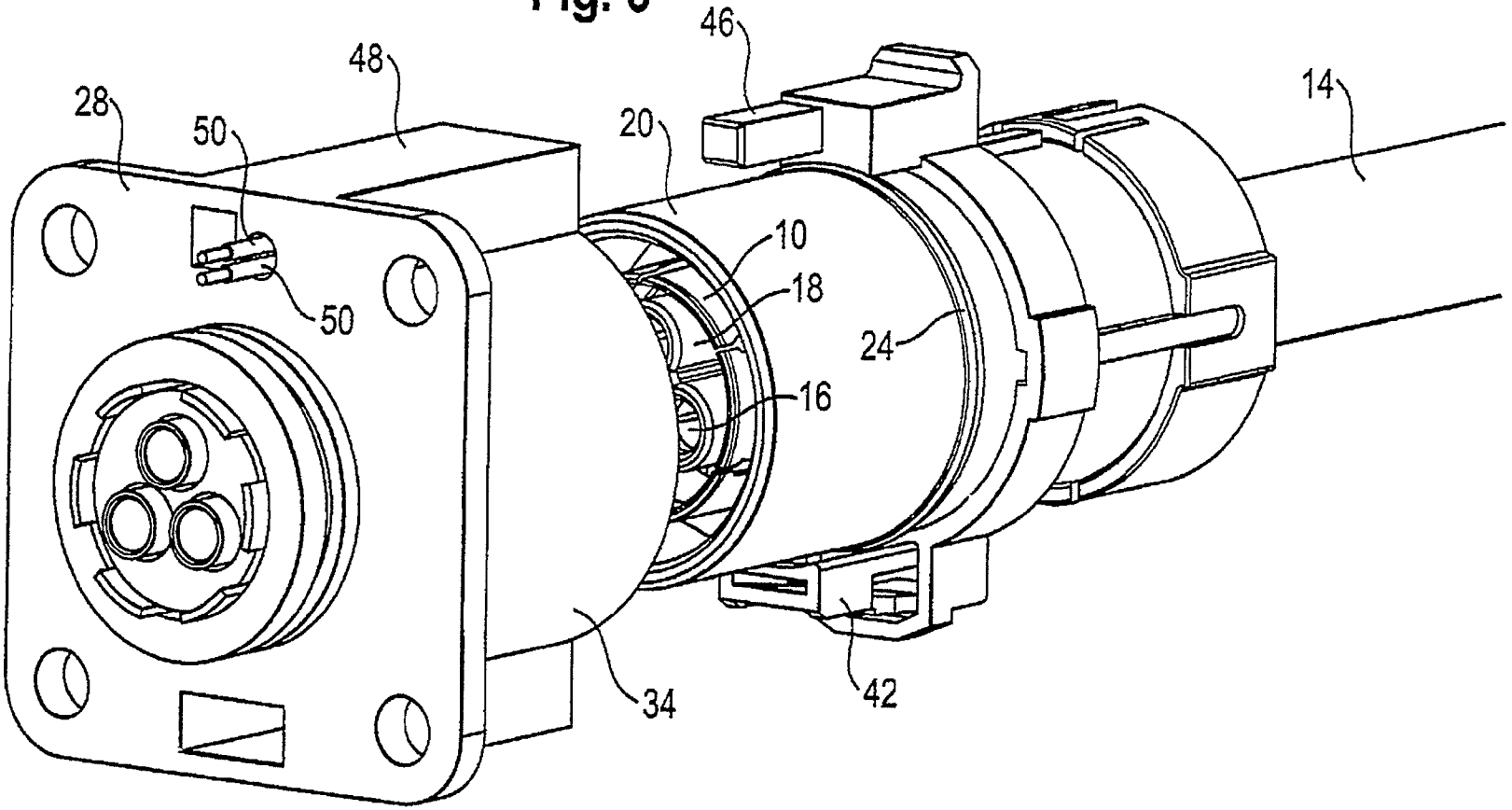
FIG. 8 shows a further perspective view of the second preferred embodiment of a plug-type connector in accordance with the invention as shown in FIG. 6 with a complementary plug-type connector in unplugged state.

FIGS. 6 to 8 show, in a second preferred embodiment of a plug-type connector in accordance with the invention, such a detector 46, which is referred to in the following as an "interlock". This interlock 46 is arranged on the outside of the housing 20 and on the bolt 42, so that the interlock 46 is moved axially together with the bolt 42. A complementary interlock 48 is arranged on the complementary plug-type connector 28, wherein the interlock 46 and the complementary interlock 48 interact to signal an established plugged connection. However, as soon as the interlock 46 and complementary interlock 48 are mechanically separated from one another, which is the case when the plug-type connector and complementary plug-type connector are released and pulled apart, a released plugged connection is indicated and an electric voltage shut off, so that the internal conductor parts 16 of the plug-type connector and the complementary internal conductor parts 30 of the complementary plug-type connector 28 can be touched without danger, without any risk of electric shock to a person touching the internal conductor parts 16. It is particularly advantageous here that the interlock 46 is arranged in an axially moveable manner on the bolt 42, because this means that a control device already detects that the plug-type connector and the complementary plug-type connector are about to be disconnected as the locking is released or as the bolt 42 moves into the release position, that is to say before the actual release of the plugged connection, so that additional time is available to shut off the transmission of electrical energy via the plug-type connector and the complementary plug-type connector.

The complementary interlock 48 on the complementary plug-type connector 28 is for example in the form of a reed relay, which selectively opens or closes an electrical circuit via electric cables 50 (FIG. 8). The interlock 46 on the plug-type connector is, accordingly, in the form of a magnet which switches the reed relay accordingly, depending on whether or not the magnet of the interlock 46 is located on the reed relay of the complementary interlock 48, which is the case in the plugged-together state of the plug-type connector and complementary plug-type connector 28 with the bolt in the locking position.

No helical spring is shown in the second embodiment of a plug-type connector in accordance with the invention as shown in FIGS. 6 to 8. However, here too the arrangement of a helical spring analogous to the first embodiment of a plug-type connector in accordance with the invention as shown in FIGS. 1 to 5 is possible.

In the second embodiment of a plug-type connector in accordance with the invention as shown in FIGS. 6 to 8, the bolt 42 possesses a rocker 52 made of a resilient material which is formed integrally with the bolt 42. This rocker 52 locks the bolt 42 in the locking position. In order to move the bolt 42 into the release position, the rocker 52 must be deflected resiliently in order for the bolt 42 to be moveable in an axial direction.

While the present invention has been particularly described, in conjunction with the specific preferred embodiment(s), it is evident that many alternatives, modifications, and variations will be apparent to those skilled in the art, in light of the foregoing description. It is therefore contemplated that the appended claims will embrace any such alternatives, modifications, and variations as falling within the true scope and spirit of the present invention.

Thus, having described the invention, what is claimed is:

1. A plug-type connector comprising an external conductor part which is formed on a cable-side end of the plug-type connector for electrical and mechanical connection with an external conductor of a cable and which forms an electromagnetic screen of the plug-type connector, having at least one internal conductor part which is formed on the cable-side end of the plug-type connector for electrical and mechanical connection with at least one internal conductor of the cable, and a housing including a radially acting latching device on an outer circumference of the housing for locking the plug-type connector in a mechanically releasable manner in a plugged-in state in which the plug-type connector is plugged, with a plug-side end axially opposite the cable-side end, into a complementary plug-type connector such that an electrical and mechanical contact is established between the internal conductor part of the plug-type connector and a complementary internal conductor part of the complementary plug-type connector as well an electrical and mechanical contact between the external conductor part of the plug-type connector and a complementary external conductor part of the complementary plug-type connector, the latching device comprising a resilient material in the form of a ring having a gap in the circumferential direction, wherein the ring is arranged on the outer circumference of the housing in a plane perpendicular to a longitudinal axis of the plug-type connector, such that a first side of the ring faces the plug-side end of the plug-type connector and a second side of the ring faces the cable-side end of the plug-type connector, wherein the ring projects in a radial direction from the outer circumference of the housing, and the ring inner diameter is greater than the ring outer diameter in the section in which the ring is located, so that the ring can be compressed radially against a spring-elastic force, the ring having a chamfer on the first and second side such that the ring has a shorter axial length on its outer circumference than on its inner circumference, wherein a bolt which can be moved between a locking position and a release position is arranged on the housing in such a way that in the locking position the bolt engages in the gap in the ring and prevents radial compression of the ring, and in the release position releases the gap in the ring so that the ring can be radially compressed when a stop edge runs onto one of the chamfers on the sides of the ring when the plug-connected state is established or released.

2. The plug-type connector of claim 1 wherein the bolt forms a slider which can be moved in an axial direction.

3. The plug-type connector of claim 1 wherein the housing is a part of the external conductor part.

4. The plug-type connector of claim 1 including a radial groove running around the outer circumference of the housing for receiving the ring.

5. The plug-type connector of claim 1 wherein the bolt is designed to fit only into the gap in the ring when the ring is in a completely relaxed state, in a radial direction, without any radial restoring forces acting radially outwards.

6. The plug-type connector of claim 1 including an elastic spring element for applying an elastic spring force to the bolt in the direction of the locking position.

7. The plug-type connector of claim 2 the elastic spring element takes the form of a helical spring which applies the spring-elastic force to the slider in an axial direction.

8. The plug-type connector of claim 6 wherein the bolt includes a rocker made of a resilient material which is formed integrally with the bolt.

9. The plug-type connector of claim 1 including a device for electrical testing of the complete establishment of a plugged connection between the plug-type connector and a complementary plug-type connector.

10. The plug-type connector of claim 9 wherein the device for electrical testing of the complete establishment of a plugged connection reports a completely established plugged connection if, in the plugged-in state, the bolt is in its locking position.

11. The plug-type connector of claim 9 wherein the device for electrical testing of the complete establishment of a plugged connection comprises an interrupted electrical conductor which is electrically closed when the plug-type connector is completely plugged into the complementary plug-type connector and the ring is locked by the bolt.

12. The plug-type connector of claim 9 wherein the device for electrical testing of the complete establishment of a plugged connection comprises a reed contact which is electrically closed when the plug-type connector is completely plugged into the complementary plug-type connector and the ring is locked by the bolt.

13. The plug-type connector of claim 2 wherein the housing is a part of the external conductor part.

14. The plug-type connector of claim 13 including a radial groove running around the outer circumference of the housing for receiving the ring.

15. The plug-type connector of claim 14 wherein the bolt is designed to fit only into the gap in the ring when the ring is in a completely relaxed state, in a radial direction, without any radial restoring forces acting radially outwards.

16. The plug-type connector of claim 15 including an elastic spring element for applying an elastic spring force to the bolt in the direction of the locking position.

17. The plug-type connector of claim 6 the elastic spring element takes the form of a helical spring which applies the spring-elastic force to the slider in an axial direction.

18. The plug-type connector of claim 14 the elastic spring element takes the form of a helical spring which applies the spring-elastic force to the slider in an axial direction.

19. The plug-type connector of claim 6 including a device for electrical testing of the complete establishment of a plugged connection between the plug-type connector and a complementary plug-type connector.

20. The plug-type connector of claim 14 including a device for electrical testing of the complete establishment of a plugged connection between the plug-type connector and a complementary plug-type connector.

21. The plug-type connector of claim 20 wherein the device for electrical testing of the complete establishment of a plugged connection reports a completely established plugged connection if, in the plugged-in state, the bolt is in its locking position.

22. The plug-type connector of claim 10 wherein the device for electrical testing of the complete establishment of a plugged connection comprises an interrupted electrical conductor which is electrically closed when the plug-type connector is completely plugged into the complementary plug-type connector and the ring is locked by the bolt.

23. The plug-type connector of claim 10 wherein the device for electrical testing of the complete establishment of a plugged connection comprises a reed contact which is electrically closed when the plug-type connector is completely plugged into the complementary plug-type connector and the ring is locked by the bolt.

* * * * *